United States Patent [19]

Sung

[11] Patent Number: 4,827,536

[45] Date of Patent: May 9, 1989

[54] NECKTIE WITH HOLDING MEANS

[76] Inventor: Henry H. Sung, 198 E. Vista Hermosa Dr., Walnut, Calif. 91789

[21] Appl. No.: 120,093

[22] Filed: Nov. 12, 1987

[51] Int. Cl.[4] ..... A41D 25/02

[52] U.S. Cl. ..... 2/145; 2/150

[58] Field of Search ..... 2/145, 150, 157

[56] References Cited

U.S. PATENT DOCUMENTS

| | | | |
|---|---|---|---|
| 1,048,393 | 12/1912 | Dewey et al. | 2/145 |
| 1,438,247 | 12/1922 | Laveran | 2/145 |
| 2,736,033 | 2/1956 | Brunetti et al. | 2/145 |

*Primary Examiner*—Louis K. Rimrodt

*Attorney, Agent, or Firm*—Erik M. Arnhon

[57] ABSTRACT

A necktie having a narrow end and a wide end accommodates an elongated slot in the underside of the narrow end. A mesh having elongated apertures is formed in the slot. In one embodiment, a pair of loops support a slideably mounted button holder which engages the selected one of the wearer's shirt buttons and provides attachment of the necktie to the shirt of the wearer. In an alternate embodiment, the elongated slot supports a mesh which engages a selected one of the buttons on the wearer's shirt to secure the tie with respect to the wearer.

16 Claims, 2 Drawing Sheets

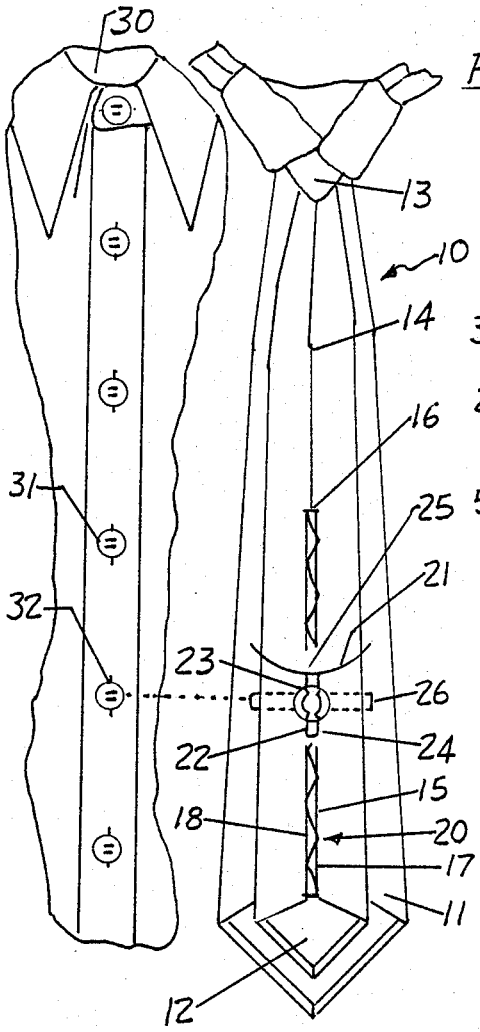
FIG 1
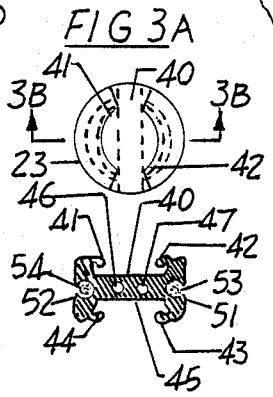
FIG 3A
FIG 3B
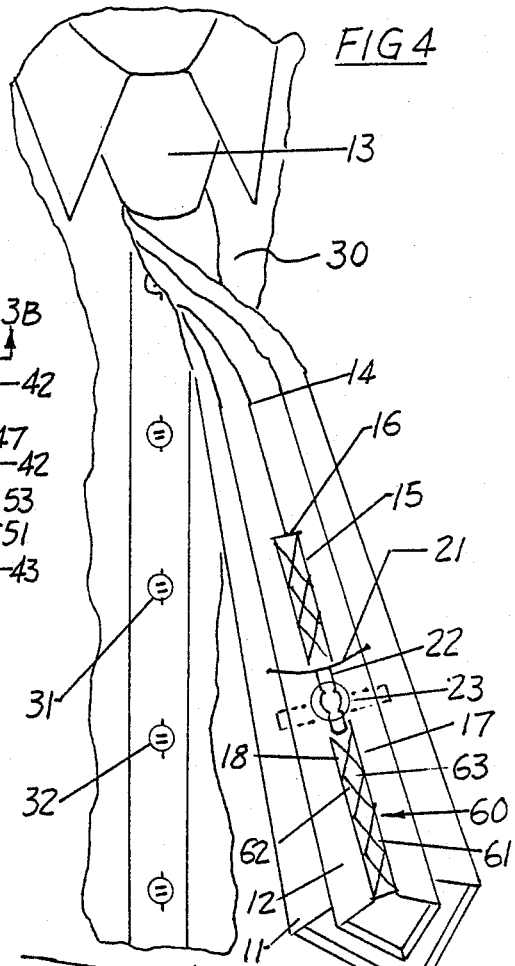
FIG 4
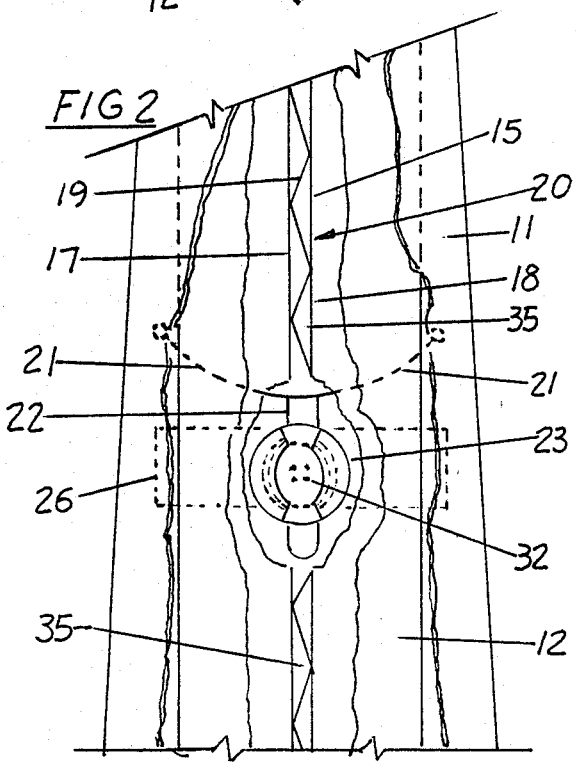
FIG 2
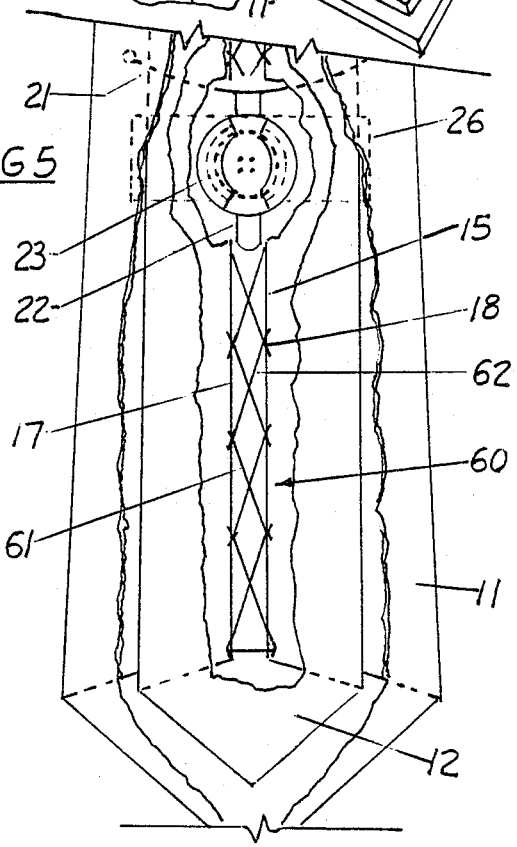
FIG 5

FIG 6
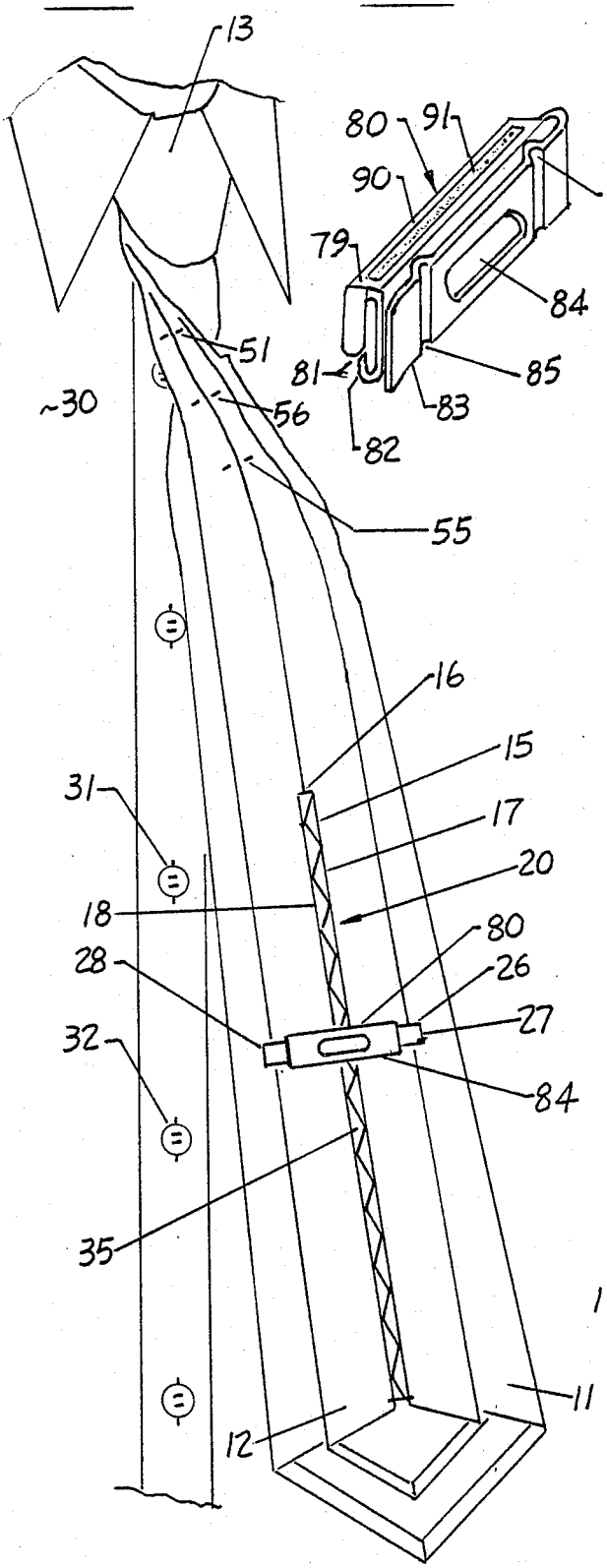
FIG 7
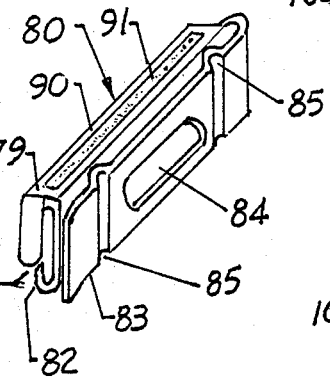
FIG 9
FIG 8
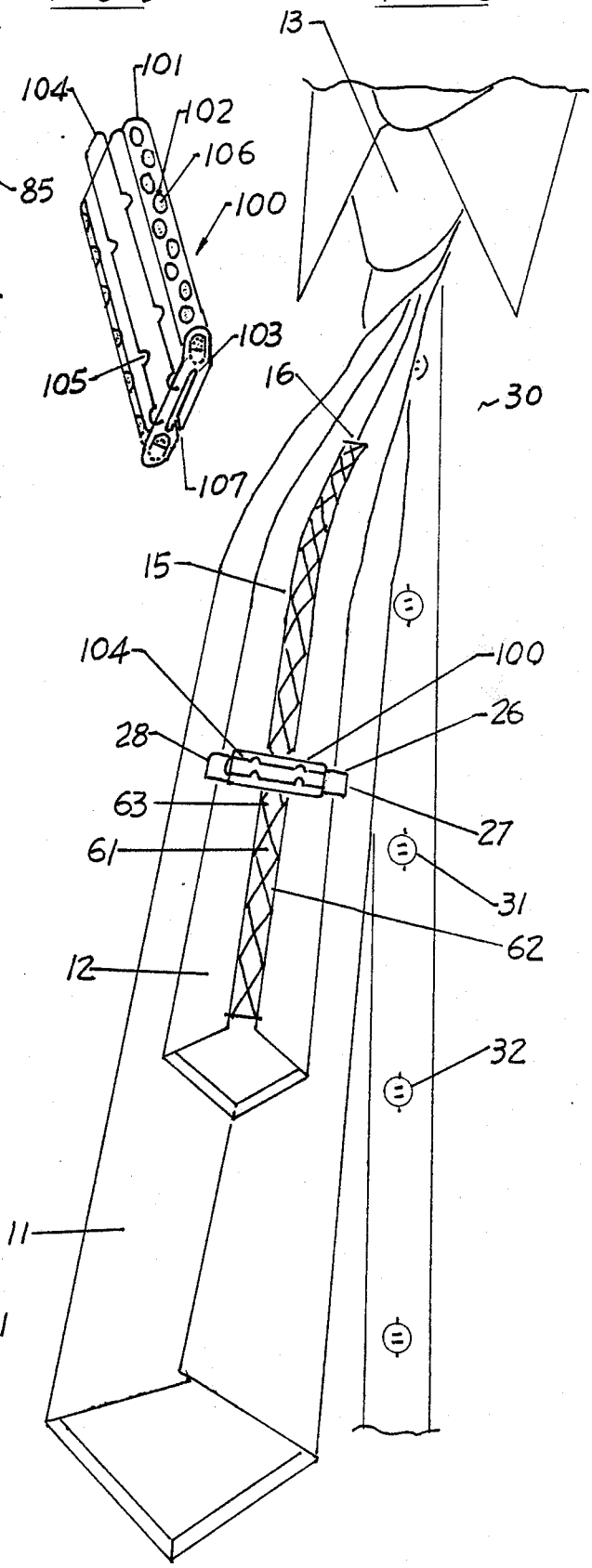

NECKTIE WITH HOLDING MEANS

FIELD OF THE INVENTION

This invention relates generally to neckties and particularly to means for holding the two ends thereof together after tying.

BACKGROUND OF THE INVENTION

With the conventional necktie used in present day dress, an elongated narrow tapered cloth or fabric tie is worn encircling the wearer's neck such that both ends meet at the wearer's shirt collar opening. Thereafter, one of the several different types of tie knots is tied by manipulating the tie ends and drawing the ends downward to form the knot. In most methods of wearing a necktie, the knot is placed at or near the wearer's throat and the two ends of the tie extend downward covering the front seam and buttons of the wearer's shirt. While the types of ties utilized varies a great deal with fashion preferences and styles of dress, most generally have one end substantially wider than the other. In such case, the object of properly tying the tie is to cause the narrower end to be covered by the wider end.

Because it is desirable for purposes of neatness of appearance to contain the tie ends with respect to the wearer's shirt, a number of devices have been created which with varying degrees of success, provide some sort of attachment to the wearer's shirt which tends to maintain the position of the wide and narrow tie ends near the front portion of the wearer's shirt.

One such apparatus is set forth in U.S. Pat. No. 2,749,553 for a NECKTIE HOLDING MEANS issued to N. Miller in which a vertical strip having a plurality of apertures is secured to the narrow end of the tie. The apertures cooperate with the buttons on the wearer's shirt to secure the narrow end of the tie to the front portion of the wearer's shirt.

U.S. Pat. No. 3,474,503 for ARTICLES OF NECK WEAR issued to J. W. Less in which an elongated member defines an elongated slot together with means for attaching the member to the underside of the wearer's tie. The elongated slot receives and captivates the proximate button on the wearer's shirt and maintains the position of the necktie.

U.S. Pat. No. 875,246 for a NECKTIE issued to C. W. T. Davies in which the narrow end of the tie defines a plurality of apertures configured to receive and captivate the shirt button of the wearer's shirt. In its normal use, the tie is tied such that the wearer's shirt button is aligned with one of the tie apertures.

U.S. Pat. No. 4,610,037 for a TIE CONSTRUCTION issued to Haymer in which a tie panel extends downwardly from the tie knot and defines a plurality of buttonholes which receive buttons from the wearer's shirt and position the tie upon the wearer's shirt. In addition, the lower end of the tie panel is formed to be folded under and against the rear face of the tie panel to adjust tie length.

U.S. Pat. No. 2,736,033 for a NECKTIE RETAINER issued to L. Brunetti et al sets forth a necktie having an elongated slit in the narrow end thereof and a plurality of stitched portions in the larger end thereof such that a button from the wearer's shirt is passed through the slit in the narrower end and is secured within one of the stitched portions of the wider end of the tie.

U.S. Pat. No. 2,813,273 for a BUTTON DOWN NECKTIE issued to A. Shreter sets forth a necktie in which the narrow end accommodates a plurality of buttonholes and in which the wider end supports a transverse member through which the narrow end is passed. When worn, the narrow end is passed through the transverse member and the most proximately placed button from the wearer's shirt is received within a selected one of the buttonholes.

U.S. Pat. No. 2,738,513 for a NECKTIE HOLDER issued to E. Carty sets forth a tie holder comprising an elongated loop secured to and depending from the transverse label portion of the tie. The loop engages and secures a conveniently located button on the shirt front of the wearer.

U.S. Pat. No. 2,422,419 for a NECKTIE issued to J. E. Johnson sets forth a necktie having a plurality of loops formed upon the underside of the wide end together with a tying cord secured to and loosely depending from the narrow end of the tie. The cord accommodates a loop at its free end and is passed through one or more of the loops on the underside of the wide end of the tie and is thereafter secured to a conveniently placed button on the shirt front of the wearer.

U.S. Pat. No. 2,588,576 for a NECKTIE HOLDING ATTACHMENT issued to N. W. Roop et al sets forth an attachment means for use in securing a tie to the shirt front of the wearer having a plurality of vertical slits which receive the most conveniently located shirt button of the wearer to secure the tie to the wearer's shirt front.

U.S. Pat. No. 2,746,055 for a HOLD DOWN NECKTIE issued to J. D. Gleason sets forth a tie having a pair of transverse slits defined in the underside of the wide end of the tie which receive and hold the narrow end of the tie. The space between the slits accommodates a plurality of buttonholes used to attach to the most conveniently located shirt button of the wearer.

U.S. Pat. No. 2,826,759 for a NECKTIE HOLDER J. A. LOEWINSOHN sets forth a necktie holder having a looped cord depending from the underside of the wide end of the necktie. A button attachment is secured to the looped cord and attaches to the most conveniently located button on the wearer's shirt.

U.S. Pat. No. 3,042,983 for a TIE HOLDER issued to R. W. Riedler sets forth a tie holder comprising a band of material configured to encircle both ends of the tie and attach to a conveniently located button on the wearer's shirt.

While the foregoing described prior art devices provide some improvement in the neatness of a wearer's tie, they often result in difficulty of attachment or restriction of the wearer's movement in obtaining their neatness improvement.

There remains therefore a need in the art for a necktie with holding means which conveniently attaches to the shirt front button of the wearer but which does not encumber the wearer's movement and does not require excessive dexterity or skill in its attachment or use.

SUMMARY OF THE INVENTION

Accordingly, it is a general object of the present invention to provide an improved necktie. It is a more particular object of the present invention to provide an improved necktie having holding means for conveniently attaching the tie to a button on the wearer's shirt. It is a still more particular object of the present invention to provide an improved necktie with holding means which is convenient and easy to use and which does not unduly restrict the wearer's movement.

In accordance with the invention there is provided a necktie having a wide end and a narrow end having a loop attached to the underside of the wide end for receiving the narrow end. An elongated slot is formed in the lower portion of the narrow end and a flexible mesh is supported upon the narrow end of the tie so as to bridge the elongated slot. The mesh is configured to receive and secure a selected one of the buttons of the wearer's shirt.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 is a rear view of a necktie with holding means constructed in accordance with the present invention;

FIG. 2 is an enlarged detailed partially sectioned view of the necktie of FIG. 1;

FIG. 3A is a detailed view of the button retaining adapter of the present invention;

FIG. 3B is a section view of the adapter of FIG. 3A taken along section lines 3B—3B in FIG. 3A;

FIG. 4 is an elevation view of an alternate embodiment of the present invention necktie with holding means;

FIG. 5 is an enlarged partially section view of the embodiment of FIG. 4;

FIG. 6 is an elevation view of an alternate embodiment of the present invention necktie with holding means;

FIG. 7 is a perspective view of the holding means of FIG. 6;

FIG. 8 is an elevation view of an alternate embodiment of the present invention necktie with holding means; and FIG. 9 is a perspective view of the alternate embodiment of the present invention necktie with holding means shown in FIG. 8.

DESCRIPTION OF THE PREFERRED EMBODIMENTS

FIG. 1 sets forth an elevation view of a necktie generally referenced by numeral 10 as seen from the underside or rear together with a portion of a typical wearer's shirt 30. Necktie 10 comprises a wide end 11 and a narrow end 12. Narrow end 12 defines a seam 14 extending a substantial portion of its length and an elongated slot 15 extending from a closed end 16 positioned at the approximate mid-point of narrow end 12 and extending downwardly to the termination of narrow end 12. A triangular mesh 20 is formed within elongated slot 15 by an extending thread or cord having alternate attachments to edges 17 and 18 of elongated slot 15. A loop 21 is secured to the underside of wide end 11 of necktie 10 and supports a downwardly extending loop 22. Loop 22 is secured to loop 21 at an attachment 25 and defines a closed end 24. A button holder 23, the structure of which is set forth below in greater detail, is secured to loop 22 in a sliding attachment. A label 26 comprises a band of material extending transversely and secured to wide end 11 of necktie 10. It should be noted that in accordance with the invention, narrow end 11 is passed through loop 21 and is thereby secured to wide end 12 of necktie 10.

Shirt 30 is of conventional construction and defines a plurality of shirt buttons extending downwardly in a front located row. With relevance to the present invention, buttons 31 and 32 are located nearest to button holder 23. In operation, with narrow end 11 passed through loop 21, a selected one of buttons 31 or 32 are secured to button holder 23. In the position shown, button 32 has been received within button holder 23 by means set forth below in greater detail. In accordance with an important aspect of the present invention, loops 21 and 22 together with button holder 23 cooperate to secure wide end 11 and narrow end 12 of necktie 10 with respect to button 32 of shirt 30. In addition, the passing of narrow end 12 through loop 21 provides an attachment between wide end 11 and narrow end 12. In addition and in accordance with an important aspect of the present invention described below in greater detail, button holder 23 is configured to be double sided in that it may attach to button 32 in the manner shown in FIG. 1 or may be inverted by raising loop 22 with respect to loop 21 until end 24 of loop 22 extends upwardly from loop 21. In the resulting position, button retainer 23 is aligned with button 31 rather than button 32. In accordance with its double sided character described below in greater detail, button holder 23 is capable of attaching to button 31 in the inverted position thus described. As a result, the present invention tie holding means may be utilized to position the button holder 23 with respect to either of two selected buttons regardless of the orientation of necktie 10 with respect to the buttons on shirt 30.

As mentioned, button holder 23 is slideable in its attachment to loop 22. Accordingly, button holder 23 may move with respect to loop 22 and provide a substantial freedom of movement for the wearer of necktie 10 in that the sliding movement of button holder 23 upon loop 22 accommodates a broad degree of relative motion between necktie 10 and buttons 31 and 32 of shirt 30.

FIG. 2 sets forth a partially sectioned view of the attachment portion of the present invention necktie with holding means as viewed from the front in which wide end 11 overlays narrow end 12. As can be seen, loop 21 supports loop 22 such that loop 22 extends downwardly therefrom. Button holder 23 is secured to button 32 upon shirt 30. In addition, label 26, secured to wide end 11 is shown in dashed line representation. As can be better seen in FIG. 2, elongated slot 15 includes parallel edges 17 and 18. In addition, a diagonal mesh 20 is formed by a zig-zag stitch within slot 15 in which the stitch is alternately attached to edges 17 and 18 of slot 15. Accordingly, mesh 20 forms a plurality of triangular shaped mesh openings 35 each having two sides formed of the diagonal stitch with the remaining side formed of either edge 17 or 18 of slot 15.

As can be seen in FIG. 2, loop 21 encloses and captivates narrow end 12 with respect to wide end 11 while supporting loop 22 and button holder 23.

FIG. 3A sets forth a detailed front view of button holder 23. FIG. 3B sets forth a section view of button holder 23 taken along section lines 3B—3B in FIG. 3A. With simultaneous reference to FIGS. 3A and 3B, it can be seen that button holder 23 defines a pair of oppositely positioned surfaces 40 and 45 on either side of a body portion 50. Body portion 50 further defines a pair of passages 46 and 47 which receive loop 22 in the sliding attachment shown in FIGS. 1 and 2. Body 50 further defines a pair of cavities 51 and 52 which support deposits of pourus material 53 and 54 respectively. The function of deposits 53 and 54 is to retain a quantity of cologne or other fragrant material. A pair of inwardly extending lips 41 and 42 extend from body 50 and are positioned above surface 40. A similar pair of inwardly extending lips 43 and 44 extend inwardly from body 50 and overlay a portion of surface 45. In accordance with an important aspect of the present invention, lips 41 and 42 and lips 43 and 44 are resiliently formed and configured to receive a typical shirt button, such as buttons 31 and 32 (in FIG. 1), in a snap attachment which secures button holder 23 thereto. In further accordance with an important aspect of the present invention, it should be noted that as mentioned above, button holder 23 may attach to a selected button using either lips 41 and 42 together with surface 40 or alternatively lips 43 and 44 together with surface 45. As a result, button holder 23 is double sided in that it may attach to a selected shirt button from either side. This double sided attachment permits the use of loop 22 in either the downwardly extending position shown in FIG. 1 or the upwardly extending alternative position described in conjunction with FIG. 1.

FIG. 4 sets forth an alternate embodiment of the present invention necktie with holding means in which necktie 10 comprises wide end 11 and narrow end 12 identical to the embodiment shown in FIG. 1. In further similarity, wide end 11 supports loop 21 which in turn supports loop 22 and button holder 23 in the identical manner to that set forth in FIG. 1. In addition, and in accordance with the embodiment set forth in FIG. 1, narrow end 12 defines an elongated slot 15 which terminates at one end in a closed end 16 and extends the remaining length of narrow end 12. Necktie 10 further defines a knot 13. Shirt 30, which is again typical of a standard dress shirt, supports a plurality of front buttons including buttons 31 and 32. A diamond-shaped mesh 60 is formed between edges 17 and 18 within slot 15 and extends the entire length of slot 15. In contrast to mesh 20 of the embodiment shown in FIG. 1, mesh 60 comprises a diamond-shaped weave of stitches 61 and 62 which zig-zag alternatively with respect to edges 17 and 18 and which are oppositely oriented with respect to each other. Accordingly, mesh 60 defines a plurality of diamond-shaped mesh openings 63 extending substantially all of the length of slot 15.

In operation, loops 21 and 22 and button holder 23 function in the identical manner to that described in the embodiment of FIG. 1 in that button holder 23 is secured to button 32 in the orientation shown in FIG. 4 or alternatively may be inverted by rotating loop 22 upwardly with respect to loop 21 to secure button holder 23 to button 31.

FIG. 5 sets forth an enlarged partially section view of the alternate embodiment of FIG. 4 as viewed from the wearer's front. Accordingly, wide end 11 overlays narrow end 12. Loop 21 is attached to the underside of wide end 11 on either side of narrow end 12. Narrow end 12 is passed through loop 21 and is thus retained in position with respect to wide end 11. Button holder 23 is secured to button 32 in the above-described manner. Mesh 60 extends the length of slot 15 and forms a plurality of mesh openings 63.

FIG. 6 sets forth an alternate embodiment of the present invention in which necktie 10 is identical in construction to the embodiment shown in FIG. 1 with the exception that loops 21 and 22 and button holder 23 have been omitted. As a result, wide end 11 and narrow end 12 are configured in the same relationship overlaying shirt 30 as shown in FIG. 1. Accordingly, necktie 10 defines a knot 13 and wide ends 11 and 12 extending downwardly therefrom. Wide end 11 supports a transverse label 26 which is secured to the underside of wide end 11 at attachments 27 and 28, In the embodiment shown in FIG. 6, narrow end 12 is passed through the opening formed between label 26 and the underside of wide end 11. Thus, the attachment of narrow end 12 to wide end 11 is in accordance with conventional custom and usage through the use of label 26. In further similarity to the embodiment shown in FIG. 1, narrow end 12 defines an elongated slot 15 having an end 16 and a mesh 20 therein. Mesh 20 is formed by a zig-zag stitch 19 extending the length of slot 15 which is alternately attached to edges 17 and 18 of slot 15. In addition, label 26 supports a retainer 80, the details of which are set forth below in FIG. 7.

In contrast to the embodiment of FIG. 1 in which the attachment of necktie 10 to buttons 31 or 32 of shirt 30 is achieved by button holder 23, the embodiment of FIG. 6 secures necktie 10 to button 31 or 32 by passing the selected button through slot 84 of retainer 80. Accordingly, in the embodiment shown in FIG. 6, button 32 is passed through slot 84 in retainer 80 as narrow end 12 and wide end 11 are positioned overlaying buttons 31 and 32. Retainer 80 may be used as a holding clip if not aligned with any of the buttons.

FIG. 7 sets forth a perspective view of retainer 80 which includes an elongated housing 79, preferably formed of a molded plastic material, and defining an elongated cavity 90. Cavity 90 supports a reservoir of absorbent material 91 which, in accordance with the invention, may be utilized to retain a quantity of fragrant material such as cologne. An elongated support 83 is secured to housing 79 at one end and defines a pair of stand-offs 85 which space support 83 from housing 79. Support 83 further defines an elongated slot 84 configured to receive the appropriate one of the buttons on shirt 30. Retainer 80 further includes a channel 82 which is secured to housing 79. Channel 82 is adapted to receive label 26 by passing label 26 through slit 81 and thereafter positioning retainer 80 upon label 26 such that label 26 is retained within channel 82.

FIG. 8 sets forth an alternate embodiment of the present invention necktie which is identical to the embodiment shown in FIG. 4 with the exception that loops 21 and 22 and button holder 23 have been omitted. Accordingly, necktie 10 defines a wide end 11 and a narrow end 12 extending downwardly from a knot 13. Wide end 11 supports a transverse label 26 attached to wide end 11 at attachments 27 and 28. Narrow end 12 is passed through the opening formed between the underside of wide end 11 and label 26. Thus, wide end 11 and narrow end 12 are secured together by label 26. As mentioned, the embodiment shown in FIG. 8 is identical to that shown in FIG. 4 with the exception of loops 21 and 22 and button holder 23. Accordingly, narrow end 12 defines an elongated slot 15 having edges 17 and 18 and terminating in a closed end 16. Label 26 supports a retainer 100, the details of which are set forth in FIG. 9. A diamond mesh 60 is formed within slot 15 by a pair of alternating zig-zag stitches 61 and 62. Stitches 61 and 62 are positioned to form a plurality of diamond-shaped apertures such as aperture 63. In accordance with the invention, narrow end 12 and wide end 11 of tie 10 are positioned overlaying shirt 30 such that button 31 is aligned with retainer 100.

FIG. 9 sets forth a perspective view of retainer 100 which comprises an elongated housing 101, preferably formed of a molded plastic material, defining a plurality of inwardly extending cavities 102, each filled with a quantity of absorbent material 106. In accordance with the invention, absorbent material 106 functions to retain a quantity of fragrant material such as mens cologne. Housing 101 further defines an internal elongated slot 103 extending through the entire length of housing 101. A slit 107 communicates with slot 103. A wire clip 104 is secured to one end of housing 101 and comprises a generally U-shaped member formed of spring wire material defining a plurality of stand-offs 105 formed along clip 104. In accordance with the invention, retainer 100 si secured to label 26, as shown in FIG. 8, by passing label 26 through slit 107 and thereafter resting retainer 100 upon label 26 such that label 26 extends through and is captivated within slot 103. In further accordance with the invention, retainer 100 is secured to a selected one of the buttons upon shirt 30, such as button 31, by passing button 31 between the spring portions of clip 104 cuasing button 31 to be captivated between clip 104 and housing 101 of retainer 100. Retainer 100 may also be used as a holding clip for the necktie if not aligned with any of the buttons.

In addition, and with reference to FIG. 6, it should be noted that narrow end 12 defines a plurality of marks 55, 56 and 57 which may be utilized to gauge appropriate point at which knot 13 should be tied to accommodate the varying heights of the wearer. For example, if knot 13 is tied such that marks 55, 56 and 57 are visible from beneath knot 13, narrow end 12 and wide end 11 will end up approximately of equal lengths as shown in FIG. 6 in which event the necktie will be configured to accommodate a shorter wearer. Conversely, in the event knot 13 is tied within the present invention necktie such that only mark 55 is visible beneath knot 13, the configuration between wide end 11 and narrow end 12 shown in FIG. 8 will result in which a substantially taller wearer may be accommodated. In accordance with an important aspect of the present invention, the lengths of slot 15 in the embodiments of FIGS. 6 and 8 readily accommodates a substantial variation in the relative position between narrow end 12 and shirt 30.

What has been shown is a necktie with holding means which provides a substantial degree of motion on the part of the wearer while providing secure attachment without complex and difficult to utilize attachment means.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with a shirt having a plurality of buttons and a necktie having a wide end portion and a narrow end portion tieable in a knot, necktie holding means comprising:

an elongated slot formed in said narrow end portion of said necktie;

a mesh defining a plurality of mesh apertures formed within said elongated slot, said mesh apertures adapted to receive a selected one of said plurality of shirt buttons in an engagement in which said button extends through said mesh; and attachment means securing said narrow end portion to said wide end portion.

2. Necktie holding means as set forth in claim 1 wherein said slot defines parallel edges and wherein said mesh is formed of a first zig-zag stitch which alternately attaches to said slot edges.

3. Necktie holding means as set forth in claim 2 wherein said wide end portion defines an under surface and wherein said attachment means includes a transverse fabric member having first and second ends attached to said under surface such that said narrow end portion passes therebetween.

4. Necktie holding means as set forth in claim 3 wherein said narrow end defines an underside having a plurality of spaced gauge marks for use in positioning said narrow end with respect to said wide end when said knot is tied.

5. Necktie holding means as set forth in claim 2 wherein said mesh further includes a second zig-zag stitch opposite to said first zig-zag stitch.

6. Necktie holding means as set forth in claim 5 wherein said wide end portion defines an under surface and wherein said attachment means includes a transverse fabric member having first and second ends attached to said under surface such that said narrow end portion passes therebetween.

7. Necktie holding means as set forth in claim 5 wherein said narrow end defines an underside having a plurality of spaced gauge marks for use in positioning said narrow end with respect to said wide end when said knot is tied.

8. For use in combination with a shirt having a plurality of buttons and a necktie having a wide end portion and a narrow end portion tieable in a knot, necktie holding means comprising:

an elongated slot formed in said narrow end portion of said necktie;

a mesh defining a plurality of mesh apertures formed within said elongated slot;

attachment means securing said narrow end portion to said wide end portion;

a first loop having first and second attachments to said wide end portion on opposite sides of said narrow end portion and a center therebetween;

a second loop extending downwardly from said center; and a button holder slideably secured to said second loop having first means for attaching to a selected one of said plurality of buttons when said second loop extends downwardly.

9. Necktie holding means as set forth in claim 8 wherein said second loop is upwardly pivotable with respect to said first loop and wherein said button holder defines second means for attaching to a selected one of said plurality of buttons when said second loop extends upwardly.

10. Necktie holding means as set forth in claim 9 wherein said button holder includes a cavity and a porous material member supported therein.

11. Necktie holding means as set forth in claim 8 wherein said button holder includes a cavity and a porous material member supported therein.

12. Necktie holding means as set forth in claim 8 wherein said button holder defines a first surface and wherein said first means for attaching to a selected one of said plurality of buttons defines a first pair of inwardly extending lips spaced above said first surface.

13. Necktie holding means as set forth in claim 8 wherein said button holder defines a second surface and wherein said second means for attaching to a selected one of said plurality of buttons defines a second pair of inwardly extending lips spaced above said second surface.

14. For use in combination with a shirt having a plurality of buttons and a necktie having a wide end portion, a narrow end portion, and a transverse label, said necktie being tieable in a knot, necktie holding means comprising:

attachment means securing said narrow end portion and said wide end portion to a selected one of said shirt buttons having an elongated housing defining an interior passage receiving said label and clip means for captivating said selected shirt button.

15. Necktie holding means as set forth in claim 14 wherein said clip means define an elongated flat clip having a slot for receiving said selected button.

16. Necktie holding means as set forth in claim 14 wherein said clip means define an elongated U-shaped wire member having transverse portions spaced to captivate said selected button.

* * * * *